US008950331B1

(12) United States Patent
Bradbury

(10) Patent No.: US 8,950,331 B1
(45) Date of Patent: Feb. 10, 2015

(54) BROADHEAD-BULLET PLASTIC ENCASED SHAFT VERSION

(71) Applicant: Michael Sean Bradbury, Eagle, CO (US)

(72) Inventor: Michael Sean Bradbury, Eagle, CO (US)

(73) Assignee: Michael Sean Bradbury, Eagle, CO (US)

( * ) Notice: Subject to any disclaimer, the term of this patent is extended or adjusted under 35 U.S.C. 154(b) by 0 days.

(21) Appl. No.: 14/145,933

(22) Filed: Jan. 1, 2014

(51) Int. Cl.
*F42B 12/34* (2006.01)
*F42B 7/10* (2006.01)
*F42B 7/00* (2006.01)

(52) U.S. Cl.
CPC .... *F42B 7/10* (2013.01); *F42B 7/00* (2013.01)
USPC ..... 102/400; 102/520

(58) Field of Classification Search
CPC ..... F42B 12/34; F42B 10/14; F42B 14/06; F42B 30/00; F42B 8/00; F42B 12/68; F42B 5/02; F42B 14/00; F42B 7/08; F42B 10/00
USPC ..... 102/400, 439, 501, 502, 504, 512, 517, 102/520–522, 532, 507, 510
See application file for complete search history.

(56) References Cited

U.S. PATENT DOCUMENTS

| | | | | | |
|---|---|---|---|---|---|
| 948,148 | A * | 2/1910 | Schenk | 102/508 |
| 1,099,784 | A * | 6/1914 | Bizas | 102/400 |
| 1,136,480 | A * | 4/1915 | O'Rawe | 102/400 |
| 1,139,916 | A * | 5/1915 | Stoehr | 102/400 |
| 1,144,818 | A * | 6/1915 | Damer | 102/400 |
| 1,152,668 | A * | 9/1915 | Sullivan | 102/400 |
| 1,204,950 | A * | 11/1916 | Damer | 102/400 |
| 1,205,715 | A * | 11/1916 | Crane | 102/400 |
| 1,225,497 | A * | 5/1917 | Rodzikevitch | 102/430 |
| 1,318,858 | A | 12/1919 | Erick | |
| 1,330,291 | A * | 2/1920 | Witkowski et al. | 102/400 |
| 1,464,032 | A * | 8/1923 | Daynik | 102/400 |
| 2,014,367 | A * | 9/1935 | Breegle | 102/436 |
| 2,661,694 | A | 5/1950 | Allen | |
| 3,893,866 | A * | 7/1975 | Hollingsworth | 473/581 |
| 4,334,657 | A * | 6/1982 | Mattson | 244/3.28 |
| 4,408,538 | A * | 10/1983 | Deffayet et al. | 102/522 |
| 4,644,866 | A * | 2/1987 | Sullivan | 102/439 |
| 4,729,320 | A * | 3/1988 | Whitten, III | 102/371 |
| 4,976,443 | A * | 12/1990 | DeLucia | 473/583 |
| 5,020,438 | A * | 6/1991 | Brown | 102/517 |
| 5,066,021 | A * | 11/1991 | DeLucia | 473/583 |
| 5,078,407 | A | 1/1992 | Carlston | |
| 5,116,224 | A * | 5/1992 | Kelsey, Jr. | 102/439 |
| 5,133,261 | A * | 7/1992 | Kelsey, Jr. | 102/439 |
| 6,174,252 | B1 * | 1/2001 | Mizek | 473/583 |
| 6,217,467 | B1 * | 4/2001 | Maleski | 473/583 |
| 6,234,082 | B1 * | 5/2001 | Cros et al. | 102/520 |
| 6,240,849 | B1 | 6/2001 | Holler | |
| 6,439,127 | B1 * | 8/2002 | Cherry | 102/519 |
| 6,571,715 | B1 * | 6/2003 | Bennett et al. | 102/439 |
| 6,588,700 | B2 * | 7/2003 | Moore et al. | 244/3.28 |
| 7,178,462 | B2 | 2/2007 | Beasley | |
| 8,646,388 | B1 * | 2/2014 | Bradbury | 102/400 |
| 2005/0217528 | A1 * | 10/2005 | Beasley | 102/510 |

* cited by examiner

*Primary Examiner* — Jonathan C Weber

(57) ABSTRACT

The Broadhead-Bullet is a new type of sub-sonic hunting projectile combining capabilities of an expandable broad head arrowhead with that of a firearm-fired projectile. The Broadhead-Bullet is for use in shorter ranges akin to shotgun slug ranges but is able to utilize the cost effectiveness, utility, and ease of use of existing firearms.

12 Claims, 10 Drawing Sheets

BROADHEAD-BULLET PLASTIC ENCASED SHAFT VERSION

CROSS-REFERENCE TO RELATED APPLICATION

This application is a continuation-in-part (CIP) of Ser. No. 13/621,592 filed Sep. 17, 2012 by the present inventor, now U.S. Pat. No. 8,646,388 issued Feb. 11, 2014, which is hereby incorporated by reference.

SEQUENCE LISTING OR PROGRAM

Not Applicable

FIELD OF INVENTION

This invention relates to firearm projectiles, more specifically a firearm projectile that combines the functionality of a retractable broad head arrowhead with that of a shotgun shell intended for use with smoothbore shotguns.

BACKGROUND OF INVENTION

Prior Art

The use of projectiles for big game hunting has been a unique method of hunting for mankind since the beginning written history. Mankind's ingenuity has perfected the firearm projectile into a highly effective hunting tool, specifically discussed here are the methods of hunting utilizing a bow and arrow and also that of the firearm and bullet. Both methods deliver a greatly enhanced method of harvesting meat via hunting and both methods offer their own advantages and disadvantages when compare to the other method of hunting discussed here. Unfortunately neither method it compatible with each other, both methods needs to be immersed within its own discipline with both the strategy and with equipment used to hunt. There have been attempts in the past to incorporate the advantages of both methods of hunting, bow and arrow and gun and bullet, but all have failed to bring a significantly superior product to the consumer market as their designs lack functionality, are too costly, do not perform well, or just plain do not work. The following are descriptions of prior art and discussions as to why these products have not been successful.

U.S. Pat. No. 1,318,858 was issued to John Frick for an expansible projectile for use in firearms and the like. Frick's invention has "outwardly projecting arms or cutting blades which are automatically positioned either due to the force of explosion or by the impact of the projectile against an object." Unfortunately Frick's invention utilizes a complex arrangement to deploy his blades including a plunger. This construction and operation of his expansible projectile make it expensive and too difficult to implement in a practical manner. The plunger style orientation for deploying the blades is also not reliable, as any variation of impact may not activate the plunger correctly. Frick's projectile also does not utilize a sabot to protect his blade while traveling the length of the firearm barrel thus allowing for destabilizing forces to disrupt the intended trajectory. The present invention is intended for use in a firearm with a smoothbore barrel such as a 12-gauge shotgun. The Broadhead Bullet relies upon a sabot or several blade mounted sabots to accurately guide it though the length of the firearm barrel.

U.S. Pat. No. 2,661,694 was issued to James Allen and William Cantrell for the Spreader Panel Bullet that "spread laterally upon impact with an object". As with Frick's invention the Spreader Panel Bullet does not incorporate a sabot to encase the projectile thus necessitating the blades and its supporting mechanisms to be encase within the projectile. This configuration is too complicated and expensive for the projectile to be except in specialty situations. The blades also are not connected to the projectile and only deploy in a forward swept position thus severely hindering its damaging potential, as this design would quickly slow the projectile as it enters the target medium. The blades would be subject to ejection from the projectile causing unpredictable performance. The supporting mechanisms for deploying the blades are complicated and therefore would be expensive and difficult to implement. The present invention utilizes a much simpler and more effective design and would thus be less expensive and yield better performance.

U.S. Pat. No. 5,078,407 was issued to Marvin Carlston for his Expandable Blade, Composite Plastic, and Broadhead Hunting Arrow Tip. Carlston here describes the use of "rotatable blades which are trunnion mounted securely in the body of the tip, and which are designed to be partially exposed while in flight". Carlston describes the function of the blades as being able to "rotate into an expanded position upon impact" and "the blades are mounted in a forward position with the tips of the blades protruding outside of the tip body". Carlston's design is one of simplicity and functionality and has been proven successful in the marketplace. Carlston's invention however is designed for bow hunting and is not for use with firearms, therefore it does not have any relevance to the present invention.

U.S. Pat. No. 6,240,849 was awarded to Christopher Holler for the Projectile with Expanding Members. Holler's invention has "open-biased arm members" that are "compressed into a restrained position" before firing the bullet. When the bullet is fired "the arms extend to the unrestrained position" which then catch the target material and slow the projectile down. Holler's invention is for a projectile suited for use in a rifled barrel and not a smooth bore shotgun as it relies upon centrifugal force for stabilization. Also his arms extend when the projectile is fired and not upon impact thus creating a massive amount of drag upon the projectile thus making it grossly inefficient as a projectile. Holler's projectile unfortunately may not be a feasible working projectile as it has many lacking characteristics that prevent it from becoming a workable firearm projectile.

U.S. Pat. No. 7,178,462 was awarded to Beasley for the Projectile with Members that Deploy Upon Impact. Beasley's projectile relies upon a "nose piece that shears off upon impact with the target, causing the nose piece to be pushed inside the projectile". The "nose piece pushes on members that deploy outwardly and lock into place, thereby greatly increasing the damage done to the target". Beasley's invention, much like Holler's, is a projectile intended for use within a rifled barrel and not a smoothbore barrel as it relies upon centrifugal force for stabilization of the projectile. Beasley's members or blades reside inside of the projectile and require an intricate mechanical arrangement for the deployment of the blades. Also the members or blades are unfortunately restricted in size due to the stowing of the blades within the bullet thus the members are also severely restricted in the amount of damage the can inflict upon the target. In all Beasley's projectile is complicated in use and construction and offers minimal advantage for the members to inflict damage therefore the concept has minimal value for its intended purpose.

OBJECTS AND ADVANTAGES

The advantages of the Broadhead Bullet are as follows:

To produce a firearm fired projectile that does not rely upon a rifled barrel for stabilization but rather in flight stabilization dependant upon airflow through its own construction and design.

To produce a sub-sonic firearm projectile that produces a much smaller noise signature than traditional supersonic firearm projectiles for discrete hunting.

To produce a low kinetic energy firearm projectile for use in a smoothbore firearm that can be used for hunting large game such as deer and elk.

To produce a firearm fired projectile with a finned stabilizer that releases from the projectile upon impact.

To produce an expandable broad head projectile that creates a wounding effect that is similar to conventional archery broad heads on the market.

To produce a firearm projectile for use in limited range projectile hunting areas as defined by hunting laws.

To produce a low kinetic energy subsonic hunting round that can be used in a smoothbore barreled firearm that would function within the firearm's action, as would ammunition for the same currently on the consumer market without modification to the function of the firearm.

To produce a projectile that does not rely upon rifled barrels and centrifugal force for the projectiles stabilization.

To produce a firearm projectile for use in 12 gauge shotguns with less recoil than Foster slugs and Buckshot.

To produce a projectile with a 100-yard center of hold for the animals kill zone. No need for specialized optics for effective hunting within 100 yards.

REFERENCE NUMERALS

1. Shaft
3. Penetrating tip
5. Pin
7. Pivoting blade
8. Pivoting blade stop
9. Fin unit
10. Fin unit support
11. Blade sheath
13. Core weight
15. Shaft blade stop
17. Wad
18. Wad support
19. Broadhead-Bullet assembly
21. Pivoting blade edge
23. Shell
25. Powder charge
26. Gun barrel
27. Target material
29. Gouge trough
31. Pin support
37. Target material
39. Broadhead-Bullet SS assembly
41. SS shaft
43. SS penetrating tip
44. SS gouge trough
45. SS pin
47. SS pivoting blade
49. SS fin unit
51. SS core weight
53. SS blade stop
55. SS wad
57. SS pivoting blade edge
59. SS pin support
61. SS pivoting blade tip
62. SS blade sheath
63. SS fin unit support
65. SS wad support

ILLUSTRATION DESCRIPTION

FIG. 1. is a side view of the Broadhead-Bullet

Figure 16:
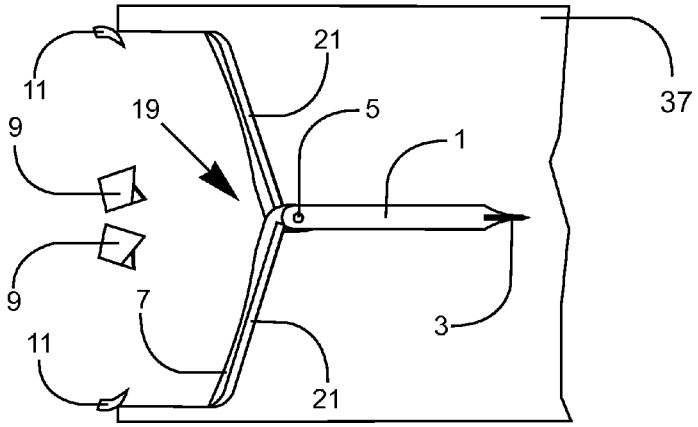
Figure 15:
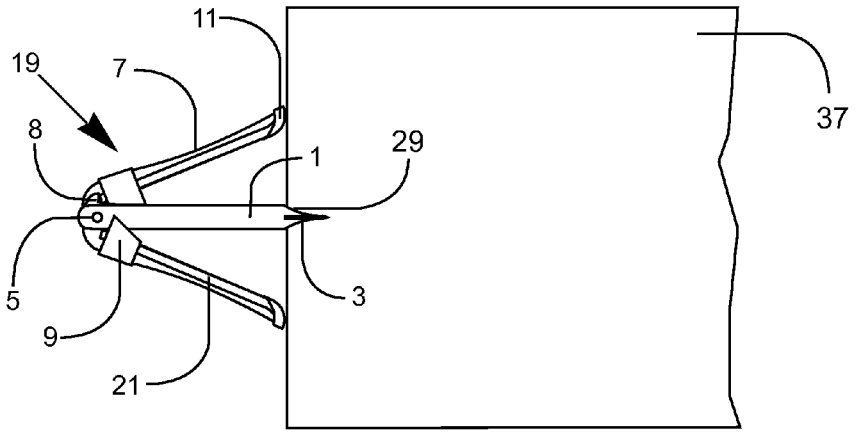
Figure 14:
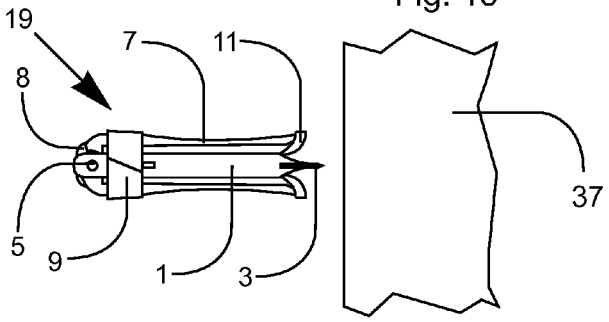

FIG. 14 details the Broadhead-Bullet in flight before impacting the Target material FIG. 15 is the Broadhead-Bullet contacting the Target material, the Pivoting blades deploying and the Wad separating FIG. 16 is the Broadhead-Bullet inside of the Target material, Pivoting Blades in fully deployed position, the Wad ejected from the Pivoting blades.

Figure 17:
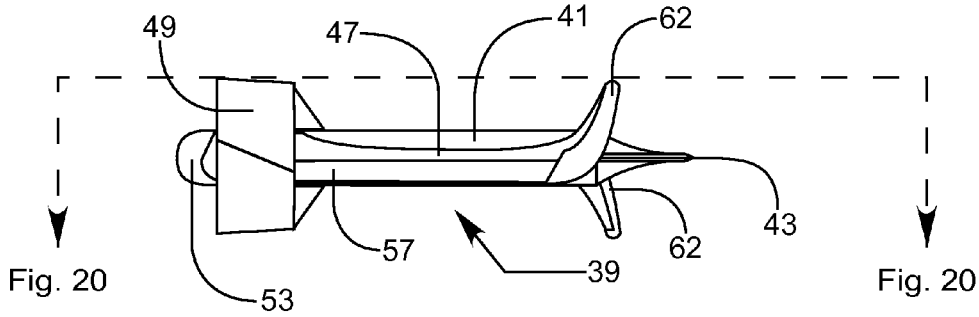

FIG. 17 is side view of the Broadhead-Bullet SS version

Figure 18:
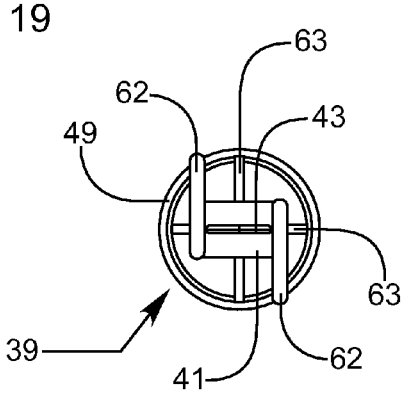

FIG. 18 is a front view of the Broadhead-Bullet SS version

Figure 19:
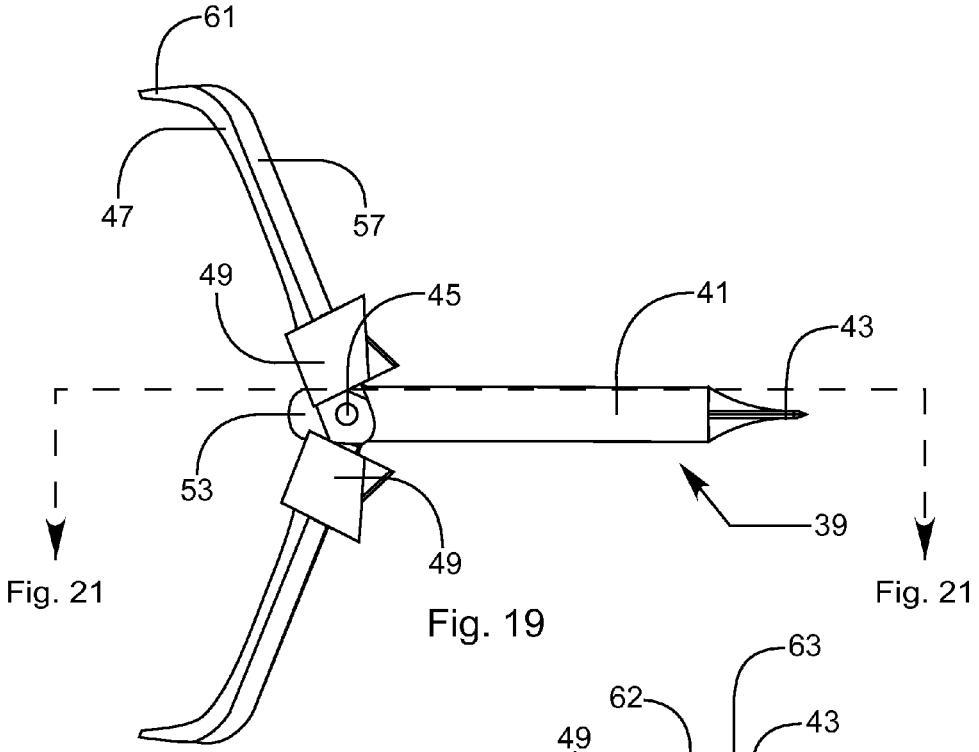
Figure 20:
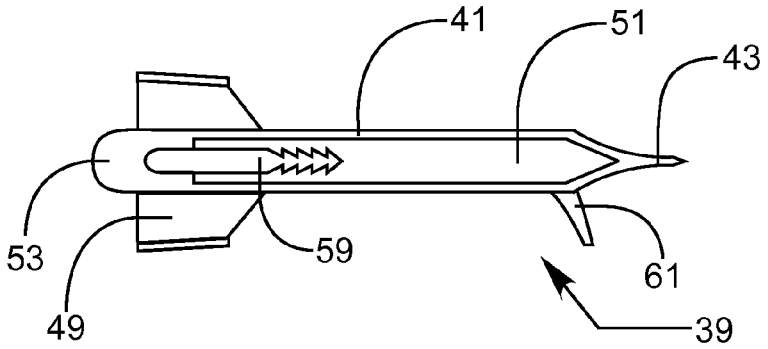

FIG. 19 is a side view of the Broadhead-Bullet SS version with the Pivoting blades deployed FIG. 20 is the Broadhead-Bullet SS version cross-sectional view from FIG. 17

Figure 21:
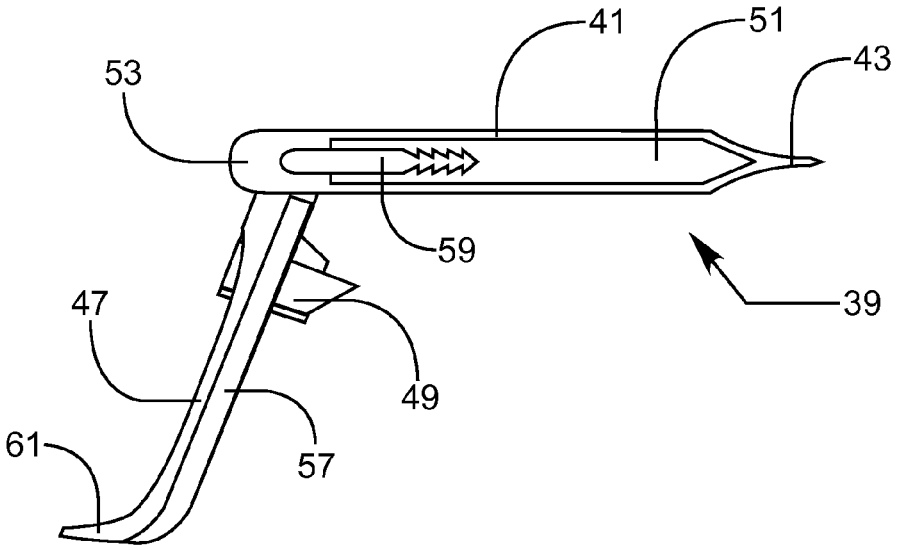

FIG. 21 is the Broadhead-Bullet SS version cross-sectional view from FIG. 19

Figure 22:
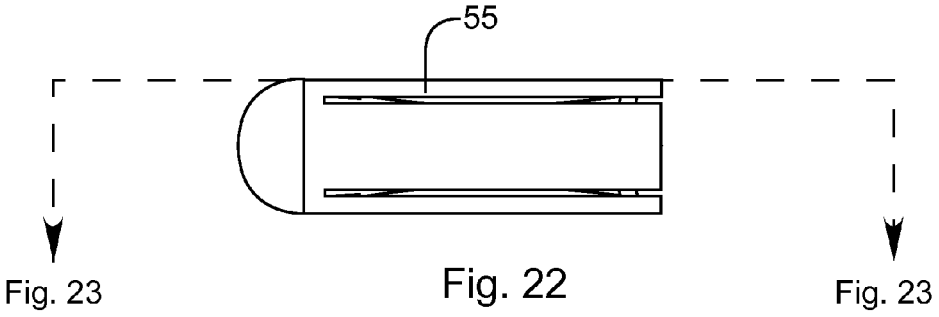

FIG. 22 is the Broadhead-Bullet SS version inside of the Wad

Figure 23:
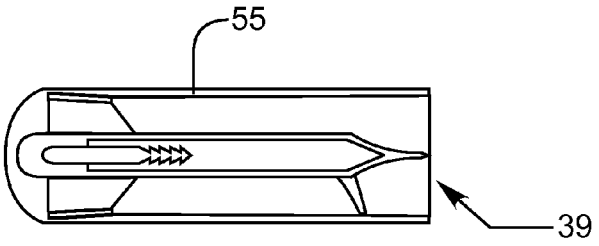

FIG. 23. is a cross-sectional view from FIG. 22

Figure 25:
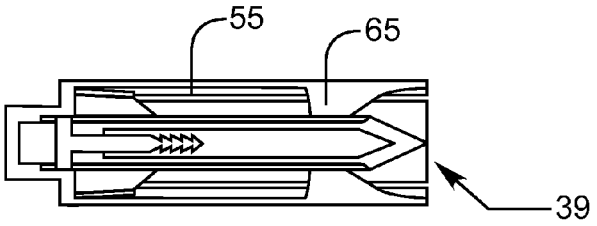
Figure 24:
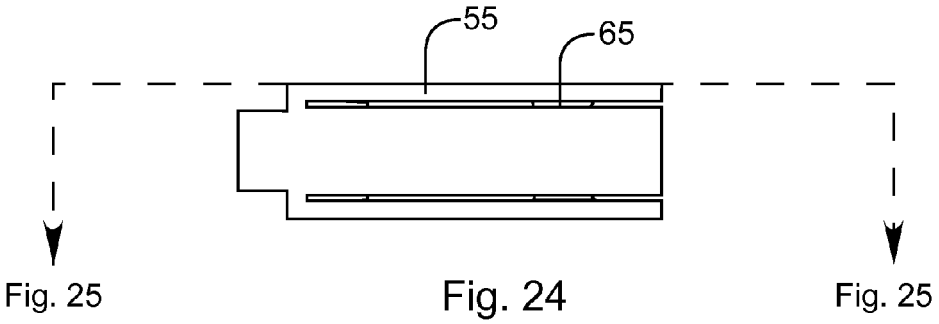

FIG. 24 is the Broadhead-Bullet SS version from FIG. 22 rotated 90 degrees on its horizontal axis FIG. 25 is a cross-sectional view from FIG. 24

Figure 26:
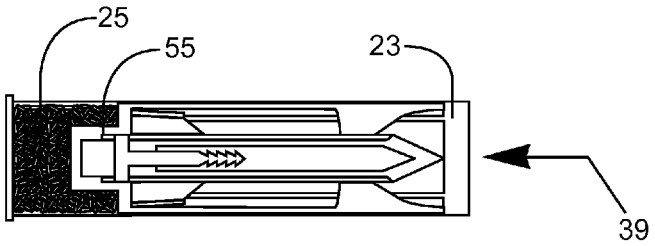

FIG. 26 is a Broadhead-Bullet SS shell cross-sectional view

Figure 27:
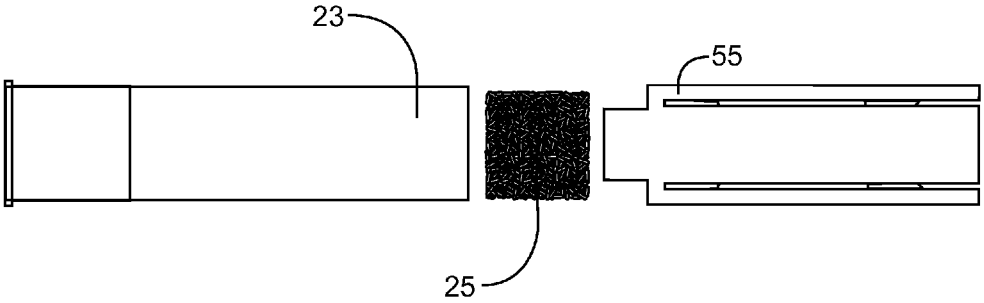

FIG. 27 is a Broadhead-Bullet SS shell exploded view

Figure 28:
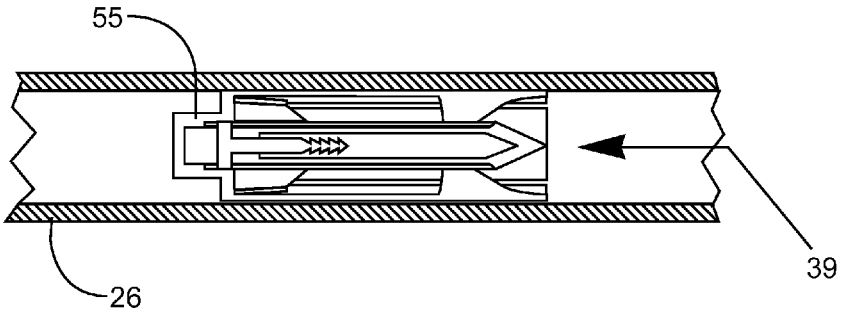
Figure 31:
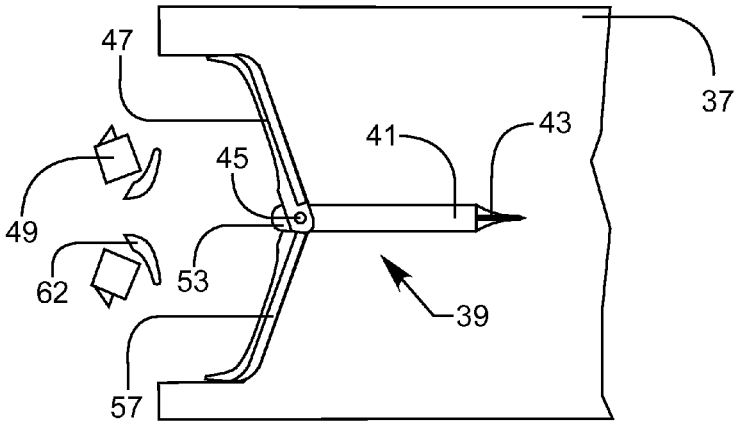
Figure 30:
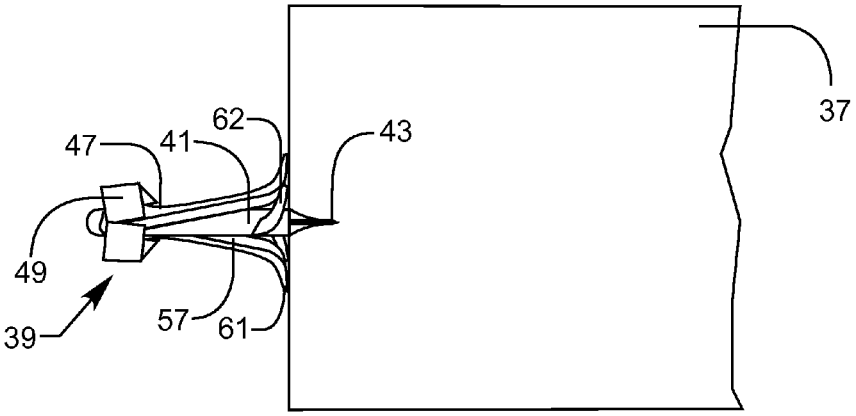
Figure 29:
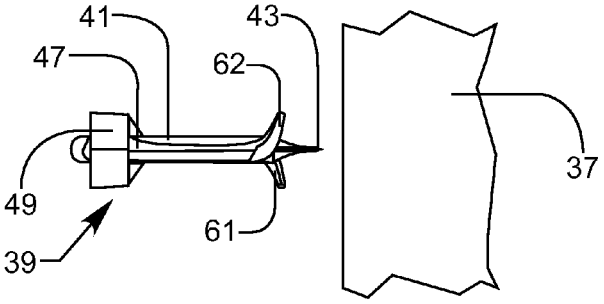

FIG. 28 is a Broadhead-Bullet SS assembly 39 inside of a gun barrel cross-sectional view FIG. 29 is Broadhead-Bullet SS assembly 39 in flight before impacting the Target material FIG. 30 is the Brodhead-Bullet SS assembly 39 contacting the Target material, the SS Pivoting blades deploying and the Wad separating FIG. 31 is the Broadhead-Bullet SS assembly 39 inside of the Target material, the SS Pivoting Blades in the fully deployed position, the Wad ejected from the SS Pivoting Blades.

DESCRIPTION

Preferred Embodiment FIGS. 1-16

Figure 3:
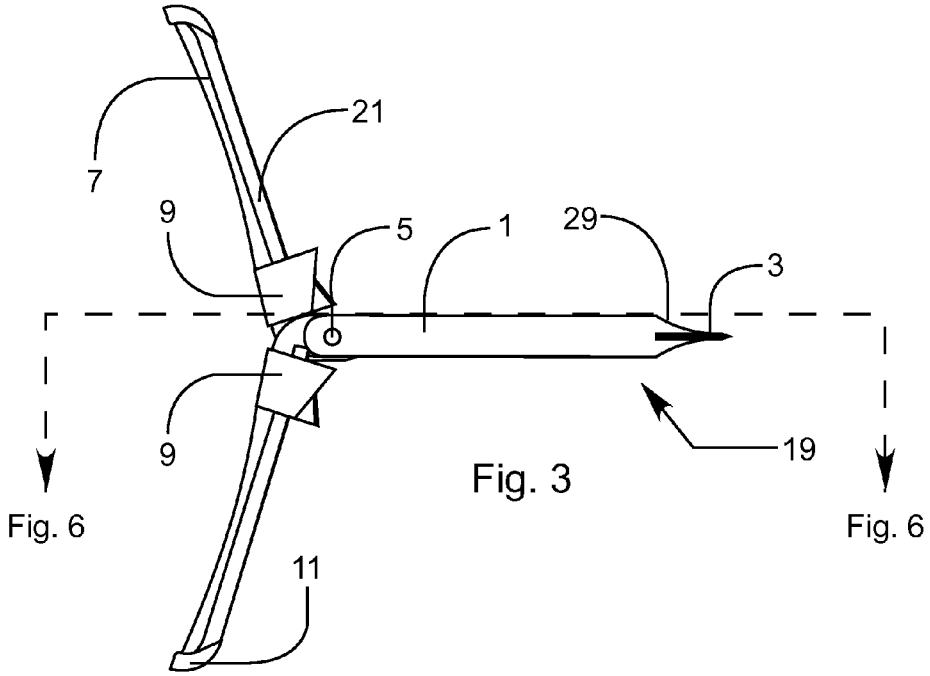
FIG. 3 is a Broadhead-Bullet side view from FIG. 2 with the Pivoting blades deployed
Figure 2:
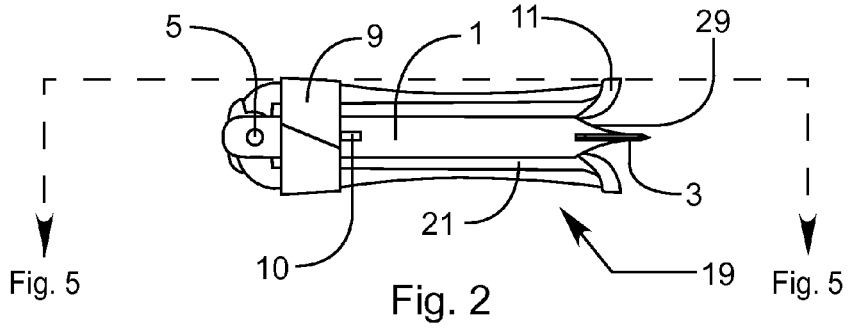
FIG. 2 is a side view of the Broadhead-Bullet from FIG. 1 rotated 90 degrees on its horizontal axis
Figure 1:
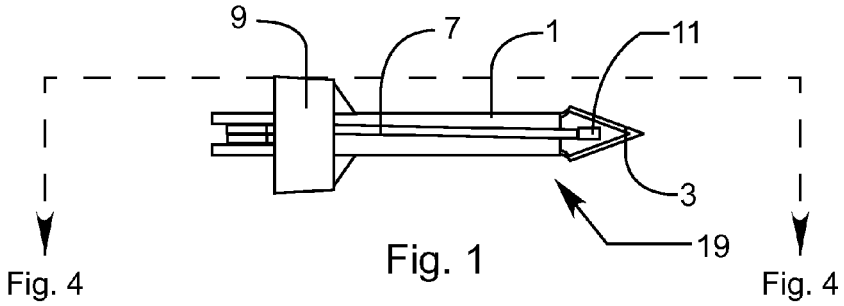
Figure 6:
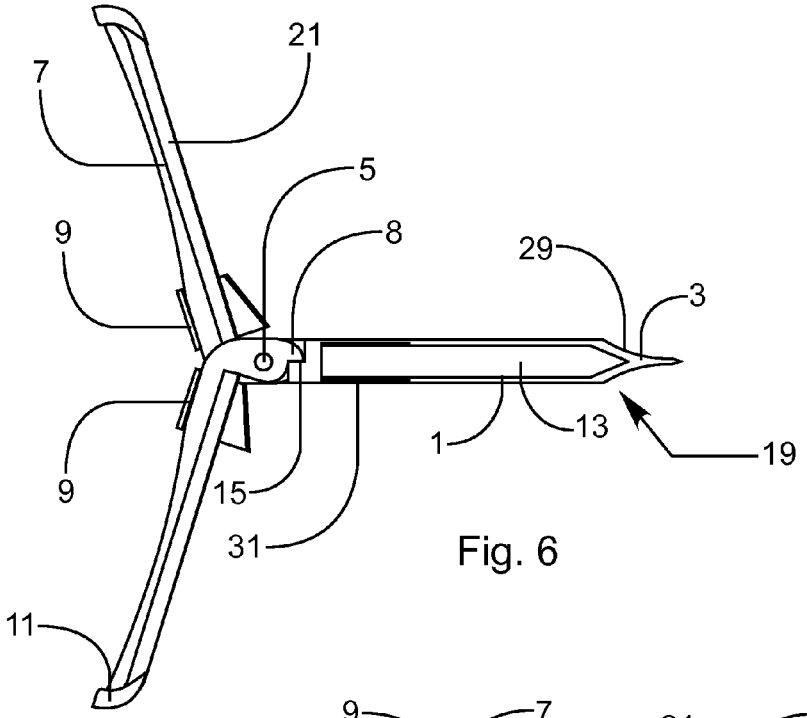
FIG. 6 is a Broadhead-Bullet cross-sectional view from FIG. 3
Figure 5:
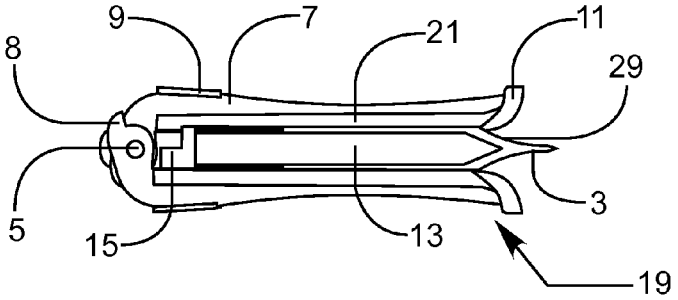
FIG. 5 is a Broadhead-Bullet cross-sectional view from FIG. 2
Figure 4:
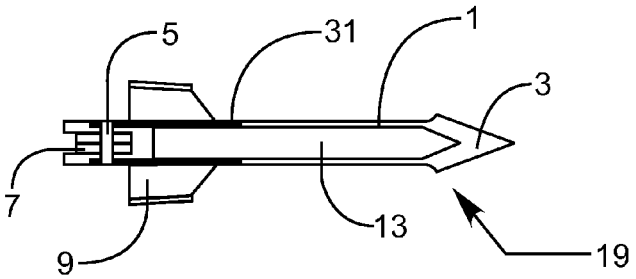
FIG. 4 is a Broadhead-Bullet cross-sectional view from FIG. 1

FIGS. 1 and 2 details the Broadhead-Bullet assembly 19 in flight. The Pivoting blades 7 here are in the stowed position, rotated forward onto the Shaft 1 on the Pin 5. Pivoting blade edges 21 rests against the Broadhead-Bullet's 19 Shaft 1. Blade sheaths 11 reside at the forward most position of the Blades 7 and are constructed from a durable material such as vinyl or similar plastic. Penetrating tip 3 resides at the frontal most portion of the Shaft 1. Gouge troughs 29 are on the front portion of Shaft 1 and behind the forward most portion of Tip 3. Both the Shaft 1 and Penetrating tip 3 here are constructed from an impact resistant material such as plastic and here consists of one continuous part. Core weight 13 here is constructed from a dense material such as lead or in the case of a lead free Broadhead-Bullet it is constructed from material with a high density quality such as steel or high-density concrete. The Shaft 1 and Penetrating tip 3 here are molded plastic surrounding and encasing the Core weight 13.

The Pin 5 here is constructed from high tensile strength material such as steel and supports the Pivoting blades 7. The Pin 5 is supported by Pin support 31, which is constructed from a high tensile strength material such as steel and can have the configuration such as a collar or wire. Pin support 31 here is connected to both the Pin 5 and Core weight 13.

Pivoting blade 7 have a Pivoting blade stop 8 located at the rear portion of the Blade 7 such that the Stop 8 creates a nodule out from the circular circumference shape of the Blade 7 portion surrounding the Pin 5. When the Pivoting blade 7 is in the fully deployed position the Pivoting blade stop 8 contacts Shaft blade stop 15, here constructed from the Shaft 1 material. Pivoting blade 7 in the fully deployed position have Pivoting blade edges 21 that face towards the Penetrating tip 3 portion of the Shaft 1.

The Fin units 9 are located near the rearward portion of the Shaft 1 and consists of two pieces that when the Blades 7 are in the stowed position they combine to contain both the Shaft 1 and Blades 7. The Fin units 9 separate into two separate pieces when the Pivoting blades 7 pivot into the deployed position.

Figure 10:
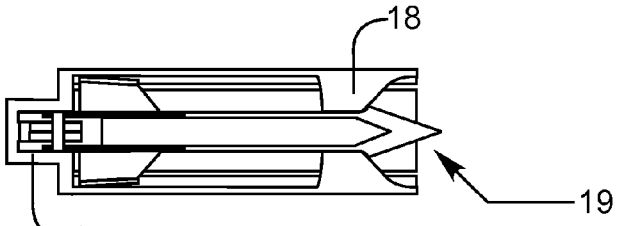
FIG. 10 is a Broadhead-Bullet is a cross-sectional view from FIG. 9.
Figure 9:
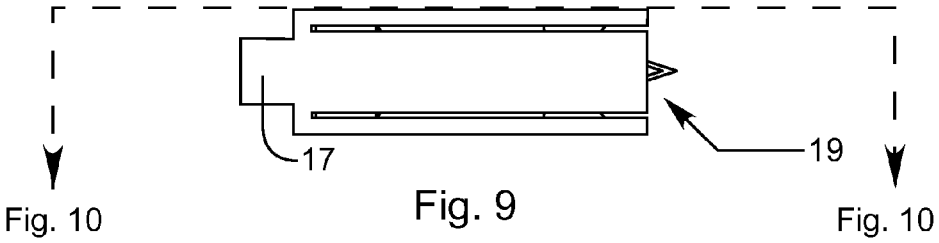
FIG. 9 is a Broadhead-Bullet from FIG. 7 rotated 90 degrees on its horizontal axis
Figure 8:
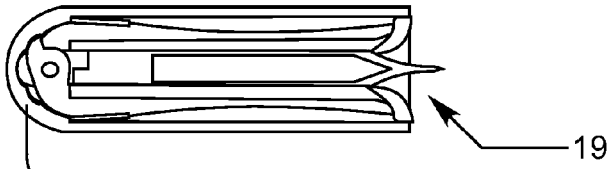
FIG. 8 is a Broadhead-Bullet cross-sectional view from FIG. 7
Figure 7:
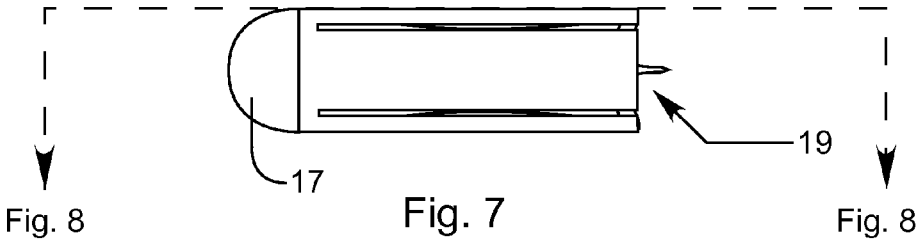
FIG. 7 is a Broadhead-Bullet inside the Wad

FIGS. 7 and 9 are side views of the Broadhead-Bullet assembly 19 with the Pivoting blades 7 stowed position; the assembly 19 is contained within the Wad 17. FIGS. 8 and 10 are cross-sectional views from FIGS. 7 and 9 respectively. Wad supports 18 are a portion of the Wad 17 that extends to the Shaft 1.

Figure 13:
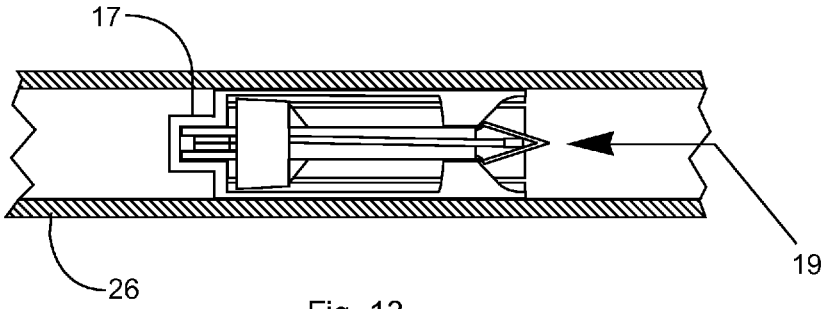
FIG. 13 is a Broadhead-Bullet inside of a gun barrel cross-sectional view
Figure 12:
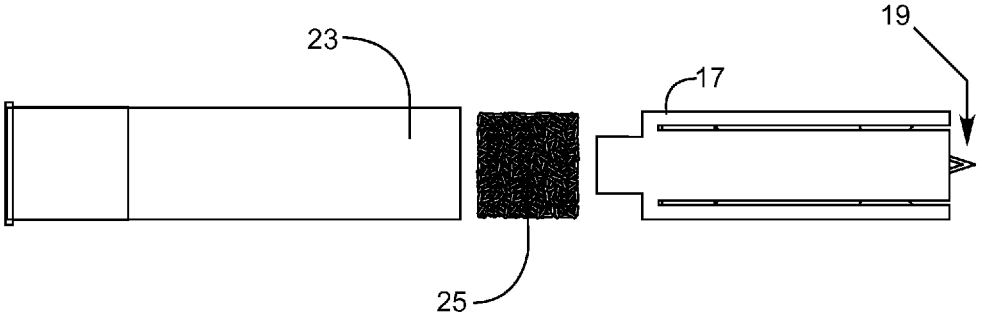
FIG. 12 is a Broadhead-Bullet shell exploded view
Figure 11:
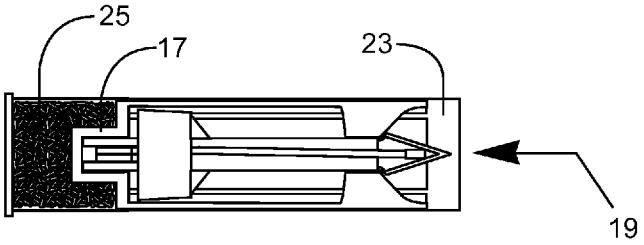
FIG. 11 is a Broadhead-Bullet shell cross-sectional view

FIG. 11 is a cross-sectional view of a Broadhead-Bullet assembly 19, Wad 17, and Powder Charge 35, inside of a Shell 23. FIG. 12 details the exploded view of the Broadhead-Bullet assembly 19 further including the Shell 33, Powder charge 35, and the Wad 17. FIG. 13 is a cross-sectional view of a Broadhead-Bullet assembly 19 inside of a Wad 19, both of which are inside of a Gun barrel 26.

FIGS. 14-16 detail the Broadhead-Bullet 19 contacting the Target Material 37. FIG. 14 details the Broadhead-Bullet assembly19 in flight before impacting the Target material 37. FIG. 15 details the Broadhead-Bullet 19 contacting the Target material 37, the Pivoting blades 7 deploying and the Wad 9 separating. Penetrating tip 3 and Gouge troughs 29 initiates Target material 37 penetration. FIG. 16 details the Broadhead-Bullet assembly 19 inside of the Target material 37. Here the Pivoting Blades 7 are in fully deployed position, the Fin unit 9 halves and Blade sheathes 11 are ejected from the Pivoting blades 7. The Broadhead-Bullet assembly 19 continues to travel through the Target material 37 with the Pivoting blades 7 cutting a wound channel through the Target material 37 until its kinetic energy is depleted.

Operation of Invention

Preferred Embodiment FIGS. 1-16

FIGS. 1-16 detail the Broadhead-Bullet assembly19 construction and operation. The Broadhead-Bullet Shot Shell here is intended to function within a 12 Gauge shotgun with a smooth bore barrel, as would a 12 Gauge shot or slug shell would. The Powder charge 25, Wad 17, and the Broadhead-Bullet assembly 19 are all contained within the Shell 23 when the Broadhead-Bullet assembly 19 is in the pre-firing state. When the Broadhead-Bullet Shot Shell is fired from the firearm, the primer ignites the Powder charge 25 after the primer is struck by the firing pin. As the Powder 25 burns the expanding gasses produced pushes the Wad 17 against the Broadhead-Bullet 19, which is in turn pushed out of the Shell 23 and into Gun barrel 26. The Wad supports 18 maintain the circular profile of the Wad 17 as well as maintaining the true position of the Broadhead-Bullet 19 along the horizontal axis of the Gun barrel 26 while the Wad 17 and Broadhead-Bullet 19 travels through the Gun barrel 26. The Wad 17, when in the Gun barrel 26, encases and protects the Broadhead-Bullet assembly 19 until it is ejected from the Gun barrel 26, where the Wad 17 is ejected from the Broadhead-Bullet 19. The purpose of the Wad 17 is to allow the Broadhead-Bullet assembly 19 to travel through the Gun barrel 26 with a tight tolerance and little friction thus giving the Broadhead-Bullet 19 the accuracy the barrel can create while the Broadhead-Bullet is in flight towards the target.

When the Pivoting blades 7 are in the stowed position the Pivoting blade edge 21 is in contact with the Shaft 1 and the two Fin unit 9 parts are in contact with each other to form a continuous Fin unit 9. In this state the Broadhead Bullet assembly 19 is either encased by the Wad 17 or is in flight sans the Wad 17.

While in flight the Fin unit 9 creates a pressure, via air flowing across the Fin unit 9, creating fluid resistance that is directed downward onto the Pivoting blades 7. This pressure is sufficient to maintain the Pivoting blades 7 stowed position during flight until the Broadhead-Bullet 19 either strikes the Target material 37 or achieves a zero velocity state. Fin unit support 10 maintains the desired shape of the Fin unit 9 when the halves are combined and until the Broadhead-Bullet 19 contacts the Target material 37 adding stability to the Broadhead-Bullet 19 during flight.

The Blade sheaths 11 have an air foil shape where the fluid resistance from the flow of air around Sheaths 11 would have a minimal value or less value than if the Broadhead-Bullet were to be sans the Sheaths 11. The combined fluid pressure effect on the Sheaths 11 and the Fin unit 9, as well as the forward position of the Core weight 13 would create a Center of Pressure rearward of the Center of Gravity therefore creating the conditions for a stable flying projectile.

The Broadhead-Bullet 19 would have a sub-sonic velocity of roughly 1000 ft/sec or 3 times the velocity compared to an arrow fired from a high-powered compound bow. This velocity would give the Broadhead Bullet assembly 19 an effective range of roughly 100 yards thus allowing for it to be used in areas limited to short ranges due to applicable hunting regulations. The trajectory of the Broadhead-Bullet 19 beyond 100 yards aggressively deteriorates.

As the Broadhead-Bullet assembly 19 strikes the Target material 37 the Blade sheaths 11 and the Penetrating tip 3 are the first portions of the Broadhead-Bullet 19 to contact the Target material 37. As the Broadhead-Bullet 19 enters the Target material 37 the Gouge trough 29 of the Penetrating tip 3 forces the Target material 37 into the Blade sheaths 11 which in turn rotates the frontal portions of the Pivoting blades 7 outward from their stowed position, pivoting the Blades 7 on the Pin 5. The Fin unit 9 halves separate as the Pivoting blades 7 deploy from the stowed position. As the Shaft 1 completely enters the Target material 37 the Pivoting Blades 7 have pivoted outward until the Blades 7 are in the fully deployed position. Here the Pivoting blade stop 8 on each Pivoting blade 7 have contacted Shaft blade stops 15 stopping the rotation of the Blades 7. The Fin unit 9 halves and Blade sheaths 11 separate from Pivoting blades 7 as the Broadhead-Bullet 19 enters the Target material 37. The fully deployed position of the Pivoting blades 7 will allow the maximum cutting effect the Pivoting blades 7 can achieve thus causing the most cutting effect to the target material as the Broadhead-Bullet assembly 19 travels through the Target material 37.

The mass of the Core weight 13 will provide the Broadhead-Bullet 19 the majority of the kinetic energy it requires to complete its trajectory and pull it through the Target material 37. The Pin support 31 will support the Pin 5 when the Broadhead-Bullet 19 strikes the Target material 37 thus keeping the Pivoting blades 7 from separating from the Shaft 1.

DESCRIPTION

Second Embodiment FIGS. 17-31

The SS pivoting blades 47 are attached to opposite sides of SS shaft 41 via SS pin 45. SS pivoting blades 47 when in the stowed position are rotated forward on SS pin 45 such that SS pivoting blade edge 57 is flush with the edge SS shaft 41. SS pivoting blade tip 61 is on located on the opposite end of SS pivoting blade 47 from SS pin 45 and have a shape that extends outward from the spine of the SS pivoting blade 47. The fore end portion of SS pivoting blade tip 61 is blunt in comparison to SS pivoting blade edge 57. A SS blade sheath 62 is attached to and encases the fore portion of the Pivoting blade tip 61. SS blade sheath is constructed from an impact resistant material such as plastic. SS penetrating tip 43 resides at the frontal most portion of the SS shaft 41. Both the SS shaft 41 and the penetrating tip 43 here are constructed from an impact resistant material such as plastic and here consist of one continuous part.

SS core weight 51 here is constructed from a dense material such as lead or in the case of a lead free Broadhead-Bullet it is constructed from material with a high density quality such as steel or high-density concrete. The SS shaft 41 and SS penetrating tip 43 here are molded plastic surrounding and encasing the SS core weight 51.

The SS Pin 45 here is constructed from high tensile strength material such as steel and supports the SS Pivoting blades 47. The SS pin 45 is supported by SS Pin support 59, which is constructed from a high tensile strength material such as steel and can have the configuration such as a collar or wire. SS Pin support 59 here is connected to both the SS pin 45 and SS core weight 51.

SS shaft 41 has SS blade stops 53 located on opposing sides and aft portion of the SS shaft 41 behind SS pivoting blades 47. SS blade stop 53 here is molded into the SS shaft 41 during SS shaft 41 construction. When SS Pivoting blades 47 are in the fully deployed position the rearward spine portion of the SS pivoting blade 47 contacts the SS shaft blade stop 53, here constructed from the SS shaft 41 material. SS pivoting blade 47 in the fully deployed position have SS pivoting blade edges 57 that face towards the SS penetrating tip 43 portion of the SS shaft 41.

The SS fin units 49 are located near the rearward portion of and encase the SS shaft 41 and stowed SS pivoting blades 47. SS fin units 49 are two separate parts that combine to surround both the SS shaft 41 and SS pivoting blades 47. The SS fin units 49 separate into two pieces when the SS pivoting blades 47 deploy.

FIGS. 22-25 detail the Broadhead-Bullet SS assembly 39 with the SS pivoting blades 47 in the stowed position and the SS Wad 55 surrounding the Broadhead-Bullet SS assembly 39 except the SS penetrating tip 43. SS wad support 65 is a portion of the SS wad 55 located near the front of the SS wad 55 and extends to contact the SS assembly 39 behind the SS penetrating tip 43. SS wad support maintains the circular profile of the SS wad 55 and the alignment of the Broadhead-Bullet SS assembly 39 with that of the Gun barrel 26 while it and the SS assembly 39 travels through the gun barrel 26. The SS wad and SS wad supports are made from a durable and flexible material such as vinyl, the same material shotgun wads currently on the market are made from.

FIG. 26 is a cross-sectional view of a Broadhead-Bullet SS assembly 39, SS wad 55, and Powder Charge 35, inside of a Shell 23. FIG. 27 details the exploded view of the Broadhead-Bullet SS assembly 39 further including the Shell 33, Powder charge 35, and the SS wad 55. FIG. 28 is a cross-sectional view of a Broadhead-Bullet SS assembly 39 inside of a SS wad 55, both of which are inside of a Gun barrel 26.

FIGS. 29-31 detail the Broadhead-Bullet SS assembly 39 contacting the Target material 37. FIG. 29 details the Broadhead-Bullet SS assembly 39 in flight before impacting the Target material 37. FIG. 30 details the Broadhead-Bullet SS 39 contacting the Target material 37; the SS pivoting blades 47 deploying and the SS wad 49 separating. The SS penetrating tip 43 initiates penetration into the Target material 37. FIG. 31 details the Broadhead-Bullet assembly 39 inside of the Target material 37. Here the SS pivoting Blades 47 are in the fully deployed position, the SS fin unit 49 halves are ejected from the SS pivoting blades 47. The Broadhead-Bullet SS assembly 39 continues to travel through the Target material 37 with the SS pivoting blades 47 cutting a wound channel through the Target material 37 until its kinetic energy is depleted.

Operation of Invention

Preferred Embodiment FIGS. 17-31

FIGS. 17-31 detail the Broadhead-Bullet SS assembly 39 construction and operation. The Broadhead-Bullet Shot Shell here is intended to function within a 12 Gauge shotgun with a smooth bore barrel, as would a 12 Gauge shot or slug shell would. The Powder charge 25, SS wad 55, and the Broadhead-Bullet assembly 39 is all contained within the Shell 23 when the SS Broadhead-Bullet assembly 39 is in the pre-firing state. When the Broadhead-Bullet Shot Shell is fired from the firearm, the primer ignites the Powder charge 25 after the primer is struck by the firing pin. As the Powder 25 burns the expanding gasses produced pushes the SS wad 55 against the Broadhead-Bullet SS 39, which is in turn pushed out of the Shell 23 and into Gun barrel 26. The SS wad supports 65 maintain the circular profile of the SS wad 55 as well as maintaining the true position of the Broadhead-Bullet SS 39 along the horizontal axis of the Gun barrel 26 while the SS Wad 55 and Broadhead-Bullet SS 39 travels through the Gun barrel 26. The SS wad 37, when in the Gun barrel 26, encases and protects the Broadhead-Bullet SS assembly 39 until it is ejected from the Gun barrel 26, where the SS wad 55 is ejected from the Broadhead-Bullet SS 39. The SS wad 55 allows the Broadhead-Bullet assembly 39 to travel through the Gun barrel 26 with a tight tolerance and little friction thus giving the Broadhead-Bullet SS 39 the accuracy the barrel can create while the Broadhead-Bullet is in flight towards the target.

When the SS pivoting blades 47 are in the stowed position the SS pivoting blade edge 57 is flush with SS shaft 41 and the two SS fin unit 49 parts are in contact with each other to form a continuous SS fin unit. In this state the Broadhead Bullet SS assembly 39 is either encased by the SS wad 55 or is in flight sans the SS wad 55.

While in flight the SS fin unit 49 creates a pressure, via air flowing across the SS fin unit 49, creating fluid resistance that is directed downward onto the SS pivoting blades 47. This pressure is sufficient to maintain the stowed position of the SS pivoting blades 47 during flight until the Broadhead-Bullet SS 39 either strikes the Target material 37 or achieves a zero velocity state. SS fin unit support 63 maintains the desired shape of the SS fin unit 49 when the halves are combined and until the Broadhead-Bullet SS assembly 39 contacts the Target material 37 adding stability to the Broadhead-Bullet SS 39 during flight. The combined fluid pressure effect on the SS fin unit 49, as well as the forward position of the SS core weight 51 would create a Center of Pressure rearward of the Center of Gravity therefore creating the conditions for a stable flying projectile.

The Broadhead-Bullet SS 39 would have a sub-sonic velocity of roughly 1000 ft/sec or 3 times the velocity compared to an arrow fired from a high-powered compound bow. This velocity would give the Broadhead Bullet SS assembly 39 an effective range of roughly 100 yards thus allowing for it to be used in areas limited to short ranges due to applicable hunting regulations. The trajectory of the Broadhead-Bullet SS 39 beyond 100 yards aggressively deteriorates.

A SS blade sheath 62 is attached to and encases the fore portion of the Pivoting blade tip 61. As the Broadhead-Bullet SS assembly 39 strikes the Target material 37 the SS blade sheaths 62 and the SS penetrating tip 43 are the first portions of the Broadhead-Bullet SS 39 to contact the Target material 37. As the SS penetrating tip 43 penetrates into the Target material 37 the SS blade sheaths 62 remain on the exterior of the Target material 37. SS pivoting blades tips 61 slide along the inside portion of SS blades sheaths 63 forcing the SS pivoting blades 47 to rotate on SS pin 45 and outward from their stowed position and into the deploying position. The SS pivoting blades 47 ends deployment when the lower spine portion of Blades 47 contact SS blade stops 53 portion of SS shaft 41. Here the SS pivoting blades 47 are oriented such that SS pivoting bladed edges 57 are facing forward towards the SS penetrating tip 43. As the Broadhead-Bullet SS assembly 39 enters the Target material 37 the SS blade sheaths and SS fin units 49 are ejected from the Broadhead-Bullet SS assembly 39. The SS pivoting blades 47 cut a wound channel through the Target material 37 until the Broadhead-Bullet SS assembly 39 depletes its kinetic energy.

The mass of the SS core weight 51 will provide the Broadhead-Bullet SS 39 the majority of the kinetic energy it requires to complete its trajectory and pull it through the Target material 37. The SS pin support 59 is connected to and supported by SS core weight 51 and SS shaft 41. SS pin support will support the SS pin 45 when the Broadhead-Bullet SS 39 strikes the Target material 37 thus keeping the SS pivoting blades 47 connected to the Broadhead-Bullet SS assembly 39.

The invention claimed is:

1. A new type of sub-sonic firearm projectile for use in a smoothbore barrel firearm comprising:

a. an elongated jacket surrounding and encasing an elongated core element, said elongated core element material has a greater density than said elongated jacket material, both said elongated core element and said elongated jacket compose a shaft;

b. a penetrating tip at a fore end of said elongated jacket whereby said penetrating tip initiates the penetration of said firearm projectile into target material;

c. two pivoting blades attached to a pin at a rear portion of said shaft, each of said pivoting blades are able to pivot independently on said pin;

d. a pivot blade stop located at the rear portion of said pivoting blade whereby said pivot blade stop creates a nodule out from said pivoting blade;

e. at least one shaft blade stop located near a aft portion of said shaft, said pivot blade stop terminates the deployment of said pivoting blade when said pivot blade stop contacts said shaft blade stop; and f. a fin unit encasing the aft portion of both said pivoting blades and said shaft, said fin unit is releasable from the projectile when said pivoting blades deploy; and g. a pin support, said pin support is attached to said core element and said pin whereby said pin support retains said pin to said core element.

2. The projectile from claim 1 further including a wad whereby said wad encases the projectile, said wad is releasable from the firearm projectile when the projectile exits the firearm barrel.

3. The projectile from claim 2 further including a shot shell containing a powder charge, said wad, and said sub-sonic firearm projectile.

4. The projectile from claim 1 further including at least one pivoting blade sabot affixed to the fore portion of each said pivoting blade whereby said pivoting blade sabots resist said pivoting blade from penetrating said target material when said pivoting blade is in the stowed position and whereby said pivoting blade sabot is releasable from said pivoting blade when said pivoting blade is in the deployed position.

5. The projectile from claim 4 further including a wad whereby said wad encases the projectile, said wad is releasable from the firearm projectile when the projectile exits the firearm barrel.

6. The projectile from claim 5 further including a shot shell containing a powder charge, said wad, and said sub-sonic firearm projectile.

7. A new type of sub-sonic firearm projectile for use in a smoothbore barrel firearm comprising:

a. an elongated jacket surrounding and encasing an elongated core element, said elongated core element material has a greater density than said elongated jacket material, both said elongated core element and said elongated jacket compose a shaft;

b. a penetrating tip at a fore end of said elongated jacket whereby said penetrating tip initiates the penetration of said firearm projectile into target material;

c. two pivoting blades attached to a pin at a rear portion of said shaft, each of said pivoting blades are able to pivot independently on said pin;

d. at least one shaft blade stop located aft of said pin, said pivot blade stop terminates the deployment of said pivoting blade when a spine of said pivot blade contacts said shaft blade stop; and e. a fin-set encasing the aft portion of both said pivoting blades and said shaft, said fin-set is releasable from the projectile when said pivoting blades deploy; and f. a pin support, said pin support is attached to said core element and said pin whereby said pin support retains said pin to said core element.

8. The projectile from claim 7 further including a wad whereby said wad encases the projectile, said wad is releasable from the firearm projectile when the projectile exits the firearm barrel.

9. The projectile from claim 8 further including a shot shell containing a powder charge, said wad, and said sub-sonic firearm projectile.

10. The projectile from claim 7 further including at least one pivoting blade sabot affixed to the fore portion of each said pivoting blade whereby said pivoting blade sabots resist said pivoting blade from penetrating said target material when said pivoting blade is in the stowed position and whereby said pivoting blade sabot is releasable from said pivoting blade when said pivoting blade is in the deployed position.

11. The projectile from claim 10 further including a wad whereby said wad encases the projectile, said wad is releasable from the firearm projectile when the projectile exits the firearm barrel.

12. The projectile from claim 11 further including a shot shell containing a powder charge, said wad, and said sub-sonic firearm projectile.

* * * * *